US009927183B2

(12) United States Patent
Pantow et al.

(10) Patent No.: US 9,927,183 B2
(45) Date of Patent: Mar. 27, 2018

(54) EXHAUST GAS HEAT TRANSFER DEVICE

(71) Applicant: Mahle International GmbH, Stuttgart (DE)

(72) Inventors: Eberhard Pantow, Winnenden (DE); Martin Bauer, West Bloomfield, MI (US); Peter Geskes, Ostfildern (DE)

(73) Assignee: Mahle International GmbH (DE)

( * ) Notice: Subject to any disclaimer, the term of this patent is extended or adjusted under 35 U.S.C. 154(b) by 206 days.

(21) Appl. No.: 14/662,223

(22) Filed: Mar. 18, 2015

(65) Prior Publication Data

US 2016/0273838 A1 Sep. 22, 2016

(51) Int. Cl.

| | |
|---|---|
| ***F28D 7/00*** | (2006.01) |
| ***F28F 9/02*** | (2006.01) |
| ***F28D 7/16*** | (2006.01) |

(52) U.S. Cl.

CPC ..... *F28D 7/0066* (2013.01); *F28D 7/16* (2013.01); *F28F 9/0236* (2013.01)

(58) Field of Classification Search

CPC ..... F28D 7/0066; F28D 7/16; F28F 9/0236; F28F 9/16; F28F 9/165; F28F 9/04; F28F 9/18; F28F 9/14; F28F 9/0241; F28F 2265/26

USPC ..... 165/158, 174

See application file for complete search history.

(56) References Cited

U.S. PATENT DOCUMENTS

| | | | | | |
|---|---|---|---|---|---|
| 1,614,159 | A * | 1/1927 | Smith | F28F 1/36 | 138/172 |
| 2,447,259 | A * | 8/1948 | Lucke | F28F 9/04 | 165/178 |
| 2,816,739 | A * | 12/1957 | Stochr | F28F 9/04 | 122/511 |
| 3,279,532 | A * | 10/1966 | Pfeil, Jr. | F28F 9/14 | 165/158 |
| 4,615,674 | A * | 10/1986 | Rathmell | F23G 7/066 | 110/204 |
| 4,930,568 | A * | 6/1990 | Janezich | F28F 9/0229 | 165/159 |

(Continued)

FOREIGN PATENT DOCUMENTS

| | | |
|---|---|---|
| DE | 8501668 U1 | 11/1988 |
| JP | S60120196 A | 6/1985 |

(Continued)

OTHER PUBLICATIONS

English Abstract for JP 2000 045884 A.

(Continued)

*Primary Examiner* — Tho V Duong
(74) *Attorney, Agent, or Firm* — Fishman Stewart PLLC

(57) ABSTRACT

The invention relates to an exhaust gas heat exchanger (1) with a housing (2), in which a tube bundle (3) with multiple tubes (4) is held via headers (5, 6), wherein in the tubes (4) a first flow path for exhaust gas (7) and between the tubes (4) and the housing (2) a second flow path for coolant (8) runs, wherein the first longitudinal ends of the individual tubes (4) of the tube bundle (3) are incorporated in a first header (5) in a fixed manner, in particular welded or brazed. It is substantial to the invention that at least one of the tubes (4) is axially moveable in the region of a second longitudinal end relative to the second header (6) and captive therein.

3 Claims, 2 Drawing Sheets

(56) References Cited

Figure 1:
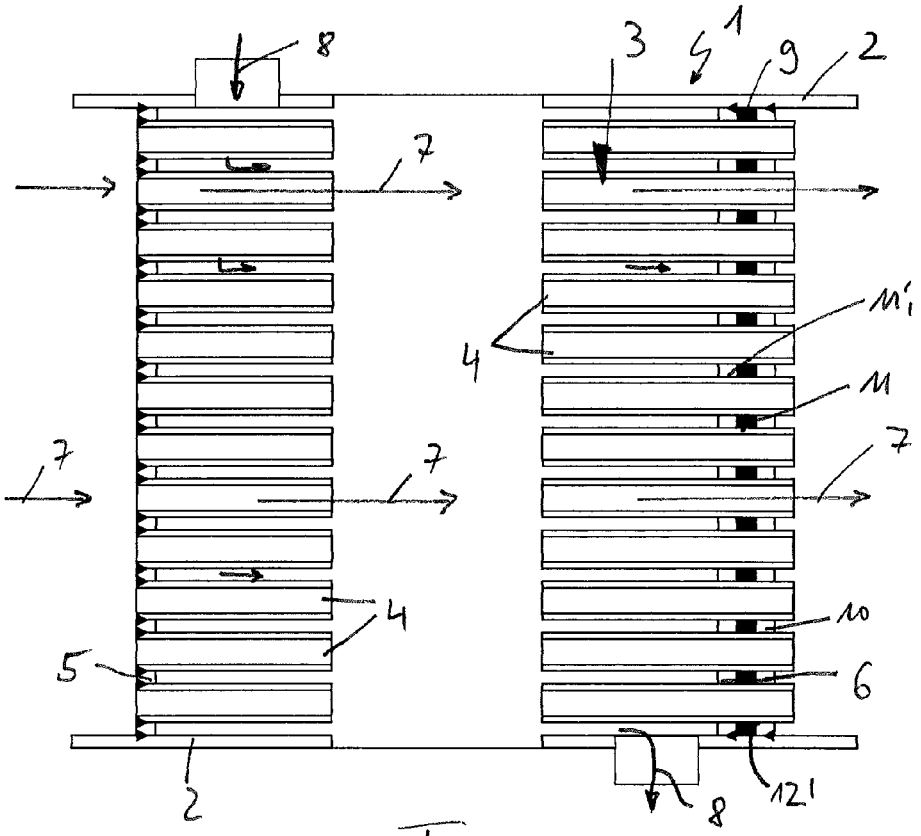

U.S. PATENT DOCUMENTS 5,323,849 A * 6/1994 Korczynski, Jr. ..... F28D 7/16
165/158
6,620,969 B1 * 9/2003 Nishimura ..... B01D 3/322
165/133

FOREIGN PATENT DOCUMENTS

JP 62108999 A * 5/1987 ..... F28F 9/0229
JP 2000045884 A 2/2000

OTHER PUBLICATIONS

English Abstract for JP S60 120196 A.
European Search Report for EP App. No. 16157426.4, dated Jul. 20, 2016.

* cited by examiner

EXHAUST GAS HEAT TRANSFER DEVICE

The present invention relates to an exhaust gas heat exchanger with a housing, in which a tube bundle with multiple tubes is held via header according to the preamble of claim 1.

From DE 10 2006 042 936 A1 a generic exhaust gas heat exchanger with a housing is known, in which a tube bundle with multiple tubes is held via headers and wherein in the tubes a first flow path for exhaust gas and between the tubes and the housing a second flow path for coolant runs. Between the housing shell and the heat exchanger a fluid-tight termination of the space there containing the second medium is provided, which on at least one end region of the housing shell has at least one expansion compensation element allowing an axial relative movement through elastic deformation of the heat exchanger with respect to the non-moveable housing shell. The intention is to be able to thereby increase the durability.

From DE 15 01 549 A1 a heat exchanger with tubes arranged in a shell comprising an inlet and outlet aperture, the ends of which tubes are fastened in transverse walls, of which one is arranged in a fixed manner and the other axially moveably in the shell, is known. The axially moveable transverse wall in this case is mounted on a suitable bearing at least indirectly connected to the shell and abuts the bearing at most subject to an intermediate layer of a lubricant. The transverse wall designed as a sliding seat is to be able to compensate temperature-related expansions in the process.

Exhaust gas heat exchangers are already employed in great diversity in modern motor vehicles to reduce nitrogen oxide emissions and, because of the comparatively high temperatures, are often produced from high-quality materials such as for example stainless steel. Exhaust gas coolers in particular produced from stainless steel have a high material value and high production costs which is why there is the desire to effectively protect such components against temperature-related damage, even when they are not operated as intended because of defects in the vehicle. In the case of coolant-cooled exhaust gas coolers there is for example a high risk of damage provided a defect occurs in the coolant circuit and the exhaust gas cooler is no longer adequately cooled. This can be caused for example through defects in the activation or failure of valves or pumps as well as by bursting of coolant pipes, clamps or screw connections. If such damage is not noticed, immediately very high consequential damage can occur. Because of the high efficiency and the low thermal inertia engine cooling components and in particular exhaust gas heat exchangers are particularly threatened by this since these severely overheat within a few seconds in the event of coolant deficiency, as a result of which in turn the life expectancy is greatly limited. Even when the internal combustion engine very rapidly changes into an emergency operation mode it cannot be reliably ensured that the exhaust gas heat exchanger remains undamaged.

In the case of a loss of the coolant pressure or in the case of an interruption of the coolant supply individual flow paths can dry up in particular in the exhaust gas heat exchangers with horizontal installation as a result of which these flow paths comparatively rapidly assume the temperature of the exhaust gas while the flow paths that are still cooled are closer to the coolant temperature. In a heat exchanger core, for example comprising a tube bundle with multiple tubes which are held in headers on the long end side, temperature differences of up to multiple 100° C. can materialize in neighbouring channels because of this, as a result of which relative changes in length of the individual tubes of up to 3 mm can occur.

Usually, the exhaust gas heat exchangers known from the prior art however are designed so that only temperature differences that occur during regular operation can be tolerated over the life expectancy so that in the case of an interruption of the coolant supply a total failure has to be expected even after a few malfunctioning incidents. Even in the event that there is a possibility to offset temperature expansions, such temperatures usually relate only to a uniform temperature change in all tubes of a tube bundle which are then held for example in the second transverse wall designed as sliding seat and are axially moveably mounted therein. A relative expansion of the individual tubes with respect to one another, for example due to drying up of individual tubes because of an interruption of the coolant supply cannot be offset.

The present invention therefore deals with the problem of stating an improvement of at least an alternative embodiment for an exhaust gas heat exchanger of the generic type which is in particular more robust against the loss of coolant in any way.

According to the invention, this problem is solved through the subject of the independent claim 1. Advantageous embodiments are subject of the dependent claims.

The present invention is based on the general idea of separately mount at least one tube, preferably all tubes, of a tube bundle of a heat exchanger core of an exhaust gas heat exchanger axially moveable so that even an individual dried-up tube can still individually expand with respect to an adjacent cooled tube without the heat exchanger core suffering damage because of this. The exhaust gas heat exchanger according to the invention comprises a housing in which a tube bundle with at least two tubes is held via headers. In the tubes themselves a first flow path for exhaust gas is provided, while a second flow path, for example for coolant, runs between the tubes and the housing. The individual tubes of the tube bundle in this case are incorporated with a first longitudinal end in a first header in a fixed manner, in particular welded or brazed. According to the invention, at least one of the tubes, preferably all of the tubes or all with the exception of one tube, is/are axially moveable relative to the second heather and captive therein. So it is designed as a sliding header seat for these tubes. Through the last mentioned feature that is substantial to the invention it is possible to offset tube-individual and temperature-specific expansions namely individually for the tubes since at least one of these is captured or mounted individually in/on the second header in an axially moveable manner. This opens up the great possibility that even when tubes dry up and said dried-up tubes greatly overheat as a consequence, said tubes can expand to a greater degree without problems than neighbouring channels (tubes) which are still cooled without the heat exchanger core itself being damaged because of this. During subsequent cooling-down resetting takes place. With such an exhaust gas heat exchanger according to the invention, the failure safety and thus the life expectancy of an exhaust gas heat exchanger can be substantially increased.

With an advantageous further development of the solution according to the invention, at least one of the tubes is held captive in the second header by means of a clearance fit, transition fit or by means of a press fit. This listing already shows that the axially moveable mounting of the second longitudinal end of at least one tube in the second header can be individually configured, wherein in the case of a suitable press fit lower requirements on a seal to be additionally implemented have to be made than in the case of a clearance fit. Passing the individual tubes through apertures arranged in the second header by means of a clearance fit obviously allows only a very small clearance.

In the subsequent passages, often the term "the tubes" is used, but it is clear, that this also comprises the term "at least one tube" of the same tenor.

Practically, a seal for sealing the individual tubes against the second header is arranged on the side of the second header facing away from the first header. This seal has apertures formed complementarily to the apertures in the second header, through which the individual tubes are inserted. In order to ensure sealing of the second flow path, a third header can be additionally provided in which the individual tubes with their second longitudinal ends are likewise held captive in an axially moveable manner, wherein the previously mentioned seal is clamped between the second and third header and in addition the second and the third header are connected to one another. Here, the seal can be designed as a permanently elastic and high temperature-compatible seal, wherein the second sliding seat header, i.e. in the present case the third header, fixes the seal arranged between the second and the third header so that the same cannot be damaged by vibration or gas pressure.

Practically, the seal is designed as an elastomer gasket with apertures formed complementarily to the tubes. These apertures in this case can be punched or already be provided during the manufacture of the elastomer seals in the mould. In order to achieve or amplify an area pressure between tubes and seals, the apertures can provide a press fit of the tubes. Here, the apertures can be shaped rounded off similar as in the case of an O-ring. Alternatively, the flat sides of the seal can also be curved outwardly between the tubes so that through the compression between the two sliding seat header, i.e. between the second and the third header, sealing with respect to the individual tubes is obtained. Instead of the seals themselves, the headers can obviously also include these curvatures.

In an alternative embodiment of the solution according to the invention, the seal is applied in a liquid form which hardens in situ. The hardening can be done with heating or initiated with UV light (UV curing). The seal material can be a silicone. Such a liquid seal is poured during the production in vertical position onto the back side of the second header between the tubes where it sets. Here, the viscosity of the still liquid sealing material and the fit of the second header have to ensure that the sealing material cannot flow through circumferencial gaps between the apertures and the tubes before setting. In this case, too, a third header is desirable in order to secure the seal against internal pressure. In order to be able to ensure permanent contact pressure, the third header in turn can comprise curvatures, in particular curvatures which are circumferencial around the aperture. It can also be practical not to fill out the space between the two headers completely with sealing material of the seal so that excessive pressure on the seal and thus damage of the same can be avoided. The previously mentioned headers, i.e. the second and the third header, can also be a common component into which the seal is introduced beforehand or subsequently.

With a further alternative embodiment of the solution according to the invention, the seal can be formed as a membrane header. Such a seal designed as membrane header can be connected to the second header or be arranged separately from the same, in particular provided it has adequate values in terms of its stiffness. In this case, the sealing function would therefore be decoupled from the second header and taken over by the seal designed as membrane header.

Further important features and advantages of the invention are obtained from the subclaims, from the drawings and from the associated figure description with the help of the drawing.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference characters relate to same or similar or functionally same components.

Figure 2:
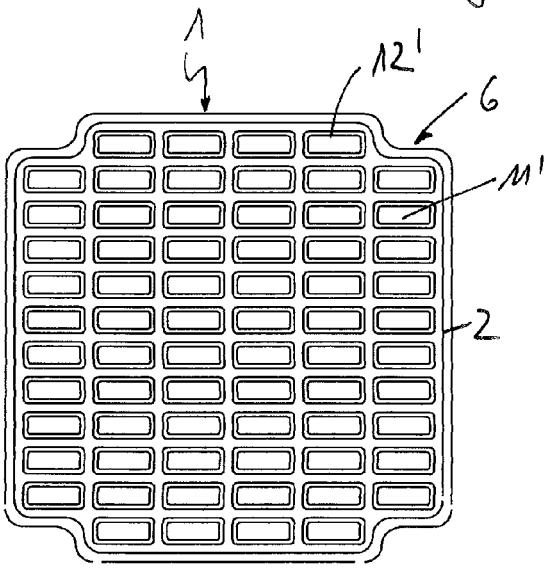
Figure 3:
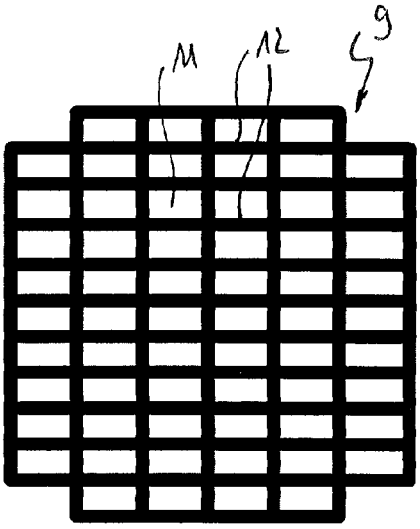
Figure 4:
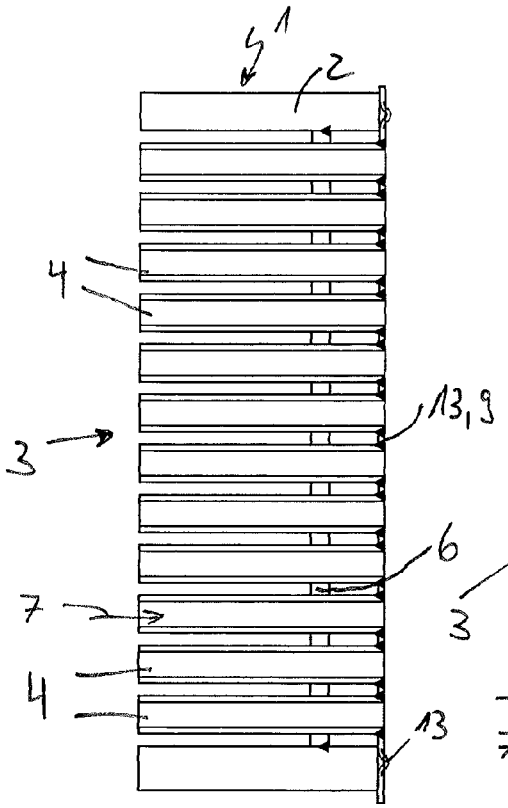
Figure 5:
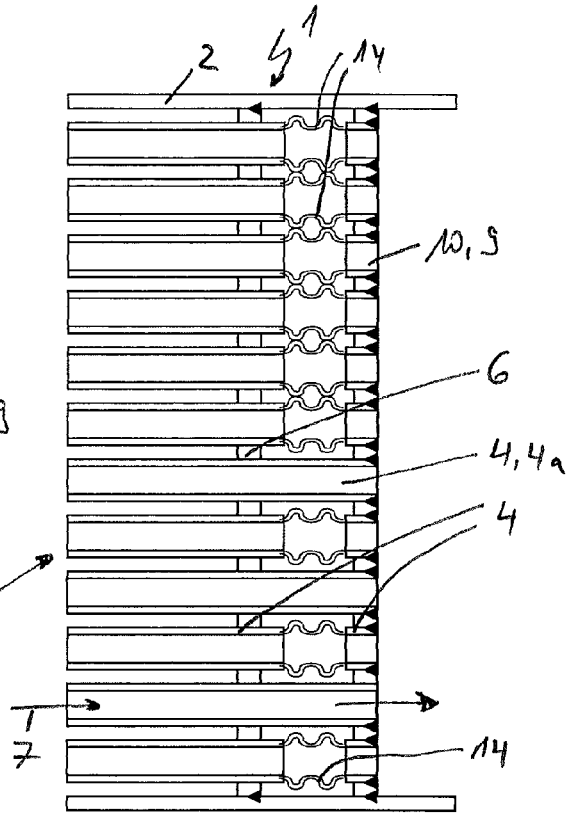
Figure 7:
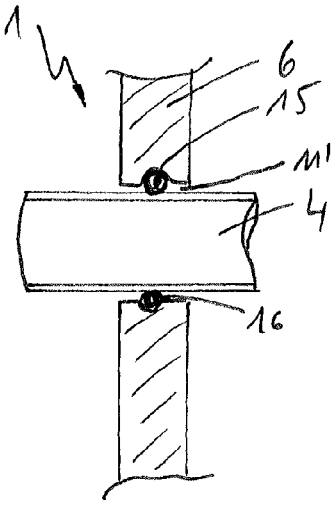
Figure 6:
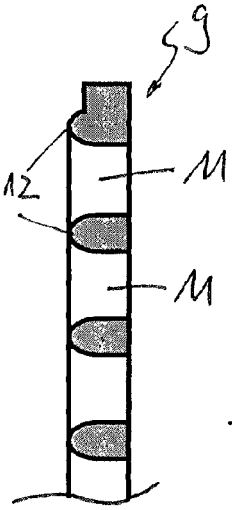

It shows, in each case schematically,

FIG. 1 a longitudinal sectional representation through an exhaust gas heat exchanger according to the invention, FIG. 2 a cross-sectional representation through an exhaust gas heat exchanger according to the invention, FIG. 3 a seal for a second header of a heat exchanger according to the invention, FIG. 4 a representation as in FIG. 1, however only in the region of a second longitudinal end of the tubes of the tube bundle, wherein the tubes are axially moveably mounted in the second header and a third header, which is designed as a membrane header, is provided, FIG. 5 a representation as in FIG. 4, however with tubes equipped with bellows between the second and third header, FIG. 6 a sectional representation through a possible embodiment of a seal, FIG. 7 a sectional representation through a second header with individual seals, which are held in a groove of the apertures of the second header.

According to FIGS. 1, 4 and 5, an exhaust gas heat exchanger 1 according to the invention comprises a housing 2, in which a tube bundle 3 with multiple tubes 4 is held via headers 5, 6. On the inlet side a first header 5 is provided here, whereas on the outlet side, a second header 6 is provided. Here, a first flow path for exhaust gas 7 runs in the tubes 4 while a second flow path for coolant 8 runs between the tubes 4 and the housing 2. The individual tubes 4 of the tube bundle 3 in this case are incorporated in a fixed manner in the first header 5 with a first longitudinal end, in particular welded or brazed. In the region of a second longitudinal end the individual tubes 4 of the tube bundle 3 are held captive axially moveably in the second header 6 designed as sliding seat header, i.e. mounted. Because of this it is possible that even in the case of an interruption of the coolant supply and the drying up of individual tubes 4 these can expand in longitudinal direction independently of the neighbouring tubes through which coolant 8 is still flowing, since these can adjust themselves in the second header 6 for the first time in longitudinal direction independently of the outer tubes 4. The first header 5 and the second header 6 in this case are connected to the housing 2 in a fixed manner, for example brazed or welded.

The individual tubes 4 can be captive in the second header 6 by means of a clearance fit, a transition fit or by means of a press fit. Looking at FIG. 1 more closely it is evident that on the side of the second header 6 facing away from the first header 5 a seal 9 (see also FIGS. 3 and 6) for sealing the individual tubes 4 against the second header 6 is arranged. This seal 9 is preferentially arranged between the second header 6 and a third header 10, wherein in the third header 10 the individual tubes 4 are likewise captive in an axially moveable manner. In addition to this, the seal 9 can be clamped in between the two headers 6 and 10 as a result of which it contacts the tubes 4 in a sealing manner. The seal 9 itself can for example be formed as an elastomer gasket with apertures 11 formed complementarily to the tubes 4, wherein the apertures 11 are punched out of a gasket for example by means of a suitable punching tool or are already produced together with the casting of the seal 9. To this end, a suitable injection or casting mould is then required.

The second longitudinal ends of the individual tubes 4 are likewise held in the apertures 11 of the seal 9 by means of a press fit. The apertures 11 of the seal 9 can additionally comprise a raised edge 12 (see in particular FIGS. 3 and 6), wherein such a raised aperture edge 13 can also be provided in the region of apertures 11' of the second or third header 6, 10.

Generally, the seal 9 can be formed as an elastomer gasket, which—as previously mentioned—has apertures 11 corresponding to the tubes 4. Alternatively to this, the seal 9 can be produced as a liquid seal, for example from silicone, wherein during the production the liquid seal is poured onto the second header 6 between the tubes 4 in vertical position, i.e. with vertically orientated tubes 4, where it sets. Here, the viscosity of the still liquid sealing material and the fit of the header 6 have to ensure that the sealing material cannot flow through gaps between the tubes 4 and the apertures 11' in the second header 6 prior to setting. In order to ensure permanent contact pressure, a third header 10 may also be required here which secures the seal 9 against internal pressure. In order to be able to ensure permanent contact pressure, the third header 10 can likewise comprise curvatures 12', wherein it can be practical not to fill out the space between the two headers 6 and 10 with the seal 9 completely, so that overpressure and thus damage to the seal 9 can be avoided.

Generally, the seal 9 can also be formed as a membrane header 13, as is shown with an embodiment version according to FIG. 4. It is likewise conceivable that the seal 9 is realized in the region of a third header 10, which however according to FIG. 5 is not formed as a sliding seat for the tubes 4 but with which the tubes 4 are connected via individual bellows 14. In the third header 10 in turn the tubes 4 are incorporated in a fixed and thus tight manner, in particular welded in or brazed in. In order to be able to ensure a predefined spacing of the third header 10 from the second header 6 one of the tubes 4, in this case the tube **4*a* can be formed continuously, i.e. without bellows 14. Despite this coupling of the tube 4*a* to the third header 10 and on the other longitudinal end to the first header 5 an individual length change of each individual tube 4, 4*a*** can be ensured.

In a further advantageous embodiment, as it is shown according to FIG. 7, the second header 6 comprises in each aperture 11' a groove 15 with a ring seal 16 arranged therein, as a result of which a tight connection between the tube 4 and the second header 6 is likewise made possible, but at the same time longitudinal expansion is also permitted.

With the exhaust gas heat exchanger 1 according to the invention it is possible for the first time to mount individual tubes 4 of a tube bundle 3 individually with respect to thermal longitudinal expansions and because of this avoid damage that occurs for example by individual tubes 4 drying up and connected with this intense heating of the same.

The invention claimed is:

1. An exhaust gas heat exchanger comprising a housing, in which a tube bundle with at least two tubes is held via a first header, a second header, and a third header, wherein a first flow path for exhaust gas runs in the tubes and a second flow path for coolant runs between the tubes and the housing and wherein the first longitudinal ends of the individual tubes of the tube bundle are incorporated in the first header in a fixed manner, wherein at least one of the tubes is axially moveable relative to the second header and captive therein, and wherein a second longitudinal end of at least one of the tubes is fixed to the third header;

wherein the individual tubes with their second longitudinal ends are incorporated in apertures in a fixed manner, wherein the tubes between the second header and the third header comprise a bellows for compensating longitudinal expansions.

2. The exhaust gas heat exchanger according to claim 1, wherein at least one tube is held captive in an aperture of the second header by means of a clearance fit, transition fit or by means of a press fit.

3. The exhaust gas heat exchanger according to claim 1, wherein all tubes are held axially moveable in the region of their second longitudinal end in the second header.

* * * * *